US005397249A

United States Patent [19]

Endo et al.

[11] Patent Number: 5,397,249

[45] Date of Patent: Mar. 14, 1995

[54] CONNECTOR WITH TERMINAL RETAINER

[75] Inventors: Takayoshi Endo; Sakai Yagi; Masanori Tsuji; Motohisa Kashiyama, all of Shizuoka, Japan

[73] Assignee: Yazaki Corporation, Tokyo, Japan

[21] Appl. No.: 89,280

[22] Filed: Jul. 12, 1993

Related U.S. Application Data

[63] Continuation-in-part of Ser. No. 925,754, Aug. 7, 1992, Pat. No. 5,322,456.

[30] Foreign Application Priority Data

Aug. 14, 1991 [JP] Japan ..... 3-064432 U
Aug. 23, 1991 [JP] Japan ..... 3-211982
Jul. 13, 1992 [JP] Japan ..... 4-185199

[51] Int. Cl.[6] ..... H01R 13/514
[52] U.S. Cl. ..... 439/595; 439/752
[58] Field of Search ..... 439/595, 752

[56] References Cited

U.S. PATENT DOCUMENTS 5,057,042 10/1991 Yamanishi et al. ..... 439/595 X
5,108,319 4/1992 Tsuji et al. ..... 439/595
5,123,866 6/1992 Endo et al. ..... 439/595 X
5,139,447 8/1992 Yoneda et al. .

FOREIGN PATENT DOCUMENTS 6358470 4/1988 Japan .

*Primary Examiner*—Eugene F. Desmond
*Attorney, Agent, or Firm*—Sughrue, Mion, Zinn, Macpeak & Seas

[57] ABSTRACT

Disclosed is a terminal retainer mounted on a rear portion of a connector housing so as to move in a two-stage manner, that is, between a provisionally-connected condition and a completely-connected condition, and in the completely-connected condition the terminal retainer can be positively engaged with metal terminals. Flexible support pieces for metal terminals are provided on a terminal retainer. A flexible retaining piece for the metal terminal is provided at each terminal receiving chamber. In the provisionally-connected condition of the terminal retainer, the flexible support piece is placed on a push-up projection of the connector housing to be held out of a path of movement of the metal terminal within the terminal receiving chamber. When the terminal retainer shifts to the completely-connected condition, a driven projection on the flexible support piece is engaged in a drive groove in the connector housing to forcibly drive the flexible support piece into engagement with the metal terminal.

8 Claims, 6 Drawing Sheets

CONNECTOR WITH TERMINAL RETAINER

This application is a continuation-in-part of application Ser. No. 07/925,754, filed on Aug. 7, 1992, now U.S. Pat. No. 5,322,456.

BACKGROUND OF THE INVENTION

1. Field of the Invention

This invention relates to a connector of the type in which a terminal retainer is connected to connection terminals, retainingly received in respective terminal receiving chambers of a connector housing, from the rear side of the terminal receiving chambers, thereby achieving a double retaining construction for retaining the connection terminals.

2. Prior Art

Referring to FIG. 7, Unexamined Japanese Utility Model Application Publication Sho. 63-58470, a designates a connector housing, and b designates a terminal retainer. A housing locking arm c of the terminal retainer b is engaged with a provisionally engaging projection e of the connector housing a in a provisionally engagement condition. After that, the terminal retainer b is further pushed to engage the housing locking arm with real engaging projection in a real engagement condition.

FIG. 8 is a showing a cross-sectional view of a condition of a temporally engagement between the connector housing a and the terminal retainer b. The terminal retainer b has a resilient terminal locking arm f. The resilient terminal locking are f includes a bulged portion $f_1$ at a free end thereof. The bulged portion $f_1$ is positioned into each terminal accommodating chamber g. A metal terminal h connected with a wire w is inserted from an rear portion into each terminal accommodating chamber g with the bulged portion being pushed up by the metal terminal h through $a_1$ window of the connector housing a until the metal terminal is engaged with a resilient locking piece i. Then, the terminal retainer b moves into the real engaging position to position the bulged portion $f_1$ of the resilient terminal locking arm f into an end portion of an electric contact portion $h_1$ of the metal terminal h. As a result, the metal terminal is doubly locked as shown in FIG. 9.

As shown in FIG. 10, in the case of where the metal terminal h is incompletely inserted, when the terminal retainer moves into the real engaging position, the bulged portion of $f_1$ of the resilient terminal locking arm f abuts against the metal terminal h to forcefully move the terminal retainer b into a normal position where the terminal retainer b is engaged with the resilient locking piece i.

However, when it is necessary to exchange the metal terminal h, the terminal retainer b should be removed from the connector housing a. Thus, the terminal remove operation is more complicated, and it is possible to lose the removed terminal retainer b.

SUMMARY OF THE INVENTION

With the foregoing in view, it is an object of this invention to provide a construction in which when a terminal retainer is shifted from a provisionally-connected condition to a completely-connected condition, flexible displaceable plates are forcibly driven to fully achieve the above-mentioned double retaining effect. Moreover, another object of the present invention is to provide a construction in which the terminal which is in the incorrect insertion can reliably be detected when the terminal retainer is shifted to the completely-connected condition.

To achieve the above object, according to the present invention, there is provided a connector with a terminal retainer comprising a connector housing having a plurality of terminal receiving chambers, and the terminal retainer mounted on a rear portion of said connector housing so as to move in a two-stage manner, that is, between a provisionally-connected condition and a completely-connected condition, wherein flexible support pieces for metal terminals are provided on said terminal retainer; a flexible retaining piece for the metal terminal is provided at each of said terminal receiving chambers; in the provisionally-connected condition of said terminal retainer, said flexible support piece is placed on a push-up projection of said connector housing to be held out of a path of movement of the metal terminal within said terminal receiving chamber; and when said terminal retainer shifts to the completely-connected condition, a driven projection on said flexible support piece is engaged in a drive groove in said connector housing to forcibly drive said flexible support piece into engagement with the metal terminal.

Further, according to the present invention, there is provided a connector of the foregoing type that, in the provisionally-connected of said terminal retainer, a distal end of the flexible support piece faces to a shock absorbing tapered surface forward slantwise extending at a rear end of the connector housing in the provisionally-connected of said terminal retainer, and that if the terminal which is in the incorrect insertion exists, the distal end of the flexible support piece is brought into contact with the shock absorbing tapered surface during the shifting from the provisionally-connected to the completely-connected condition.

Through the agency of the driven projection, the drive groove positively guides the flexible support piece to the position where this flexible support piece is engaged with the metal terminal. Moreover, the shock absorbing tapered surface guide the flexible support piece of the terminal retainer to the outside of the path of movement of the terminal during the shifting from the provisionally-connected condition to the completely-connected condition.

DETAILED DESCRIPTION OF THE PREFERRED EMBODIMENTS

Preferred embodiments will now be described with reference to the accompanying drawings.

Figure 5:
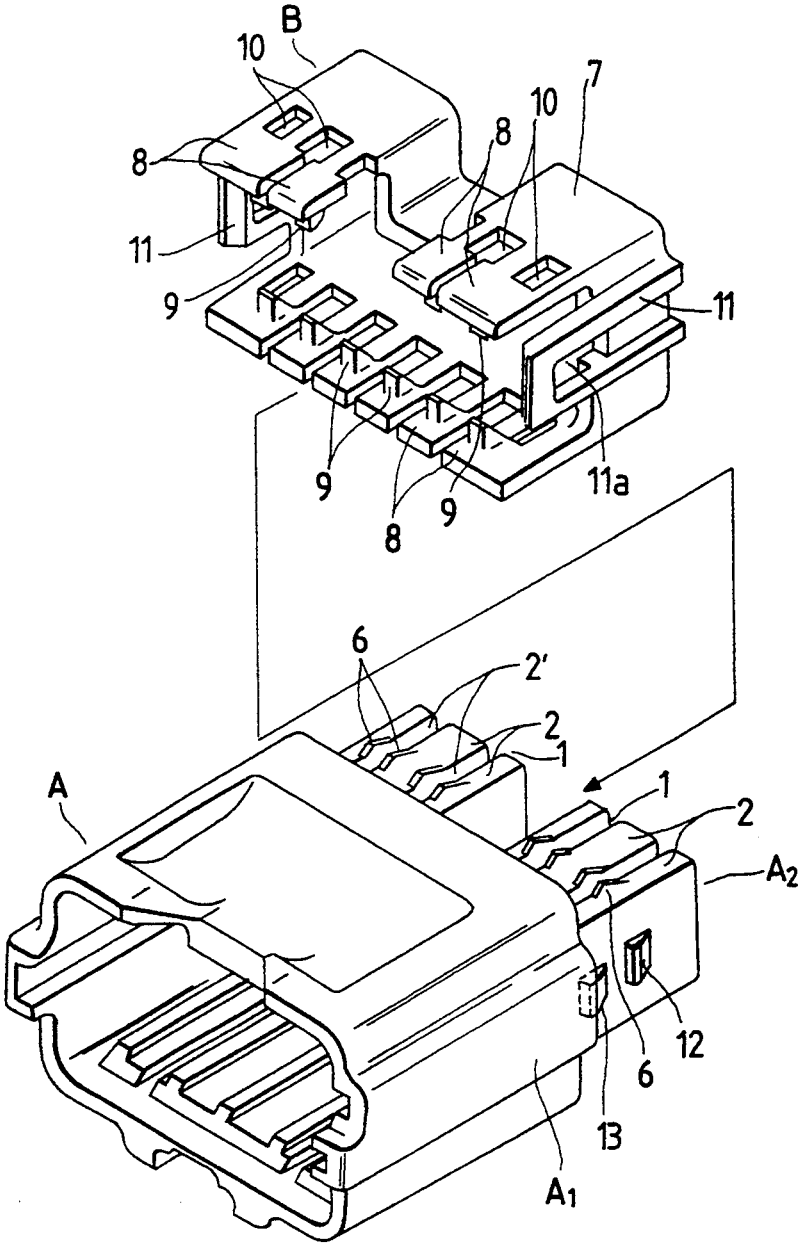
FIG. 5 is a perspective view of a first embodiment of the present invention, showing a connector housing and a terminal retainer in a separated condition.

Referring to FIG. 5, each of a connector housing A and a terminal retainer B is integrally molded of a synthetic resin.

The connector housing A has a hood portion $A_1$ at its front half portion, and a terminal receiving chamber block $A_2$ at its rear half portion with a peripheral wall removed.

Wall plates 2 are provided on opposite sides of each terminal receiving chamber 1, respectively, and the terminal receiving chamber 1 is open rearwardly and also upwardly (in the drawings) or downwardly (perpendicularly to the axis) as at 2' between the wall plates 2. Each terminal receiving chamber 1 has a flexible retaining piece 3 for a metal terminal C, and an intermediate partition wall 4 of the terminal receiving chamber has a terminal insertion hole 5 directed forwardly.

Push-up projections 6 are formed respectively on the edges of the wall plates 2, and are arranged in a row, the push-up projection 6 having a tapered surface extending in the front-to-rear direction.

A plurality of flexible displaceable plates 8, corresponding in arrangement to the terminal receiving chambers 1, are formed in a cantilever manner on upper and lower portions of a frame 7 of the terminal retainer B for receiving the terminal receiving chamber block $A_2$. A terminal retaining projection 9 is formed on the inner surface of the flexible displaceable plate 8, and relief notches 10 are formed rearwardly of the terminal retaining projections 9. When the terminal retainer B is to be connected to the connector housing A, the flexible displaceable plate 8 slides on the two wall plates 2 forming the terminal receiving chamber 1, and the terminal retaining projection 9 extends into the terminal receiving chamber 1.

Housing retaining arms 11 each having a retaining hole 11*a* are formed on and project forwardly from the opposite sides of the main frame 7 of the terminal retainer B, respectively. A provisionally-retaining projection 12 and a completely-retaining projection 13 for the housing retaining arm 11 are formed on the outer surface of each of the opposite-side wall plates 2 of the connector housing A, the two retaining projections 12 and 13 being spaced from each other in the front-to-rear direction.

Figure 6A:
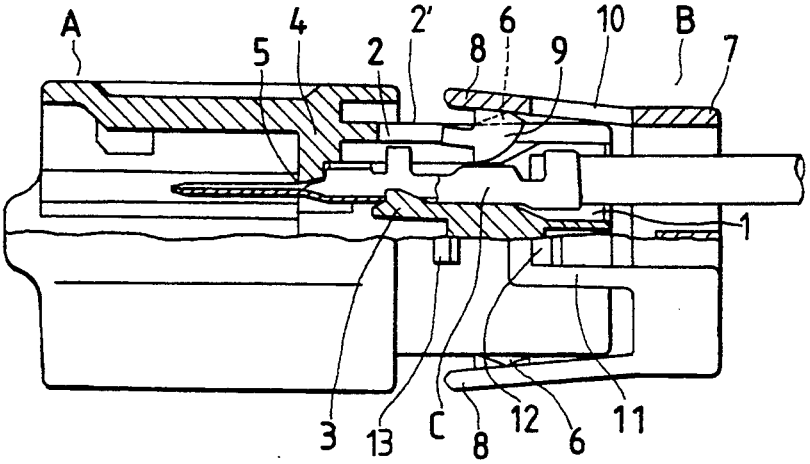
FIGS. 6 (A), (B) and (C) are cross-sectional views of a first embodiment, showing a provisionally-connected condition, a transition to a completely-connected condition, and the completely-connected condition, respectively.

FIG. 6(A) is a cross-sectional view showing a provisionally-connected condition in which the housing retaining arms 11 of the terminal retainer B are engaged with the provisionally-retaining projections 12 of the connector housing A, respectively. In this case, the flexible displaceable plates 8 are placed on the respective push-up projections 6, so that each terminal retaining projection 9 is disposed out of the path of insertion of the metal terminal C within the terminal receiving chamber 1. Therefore, the metal terminal C can be smoothly inserted to be retained by the flexible retaining piece 3.

Figure 6B:
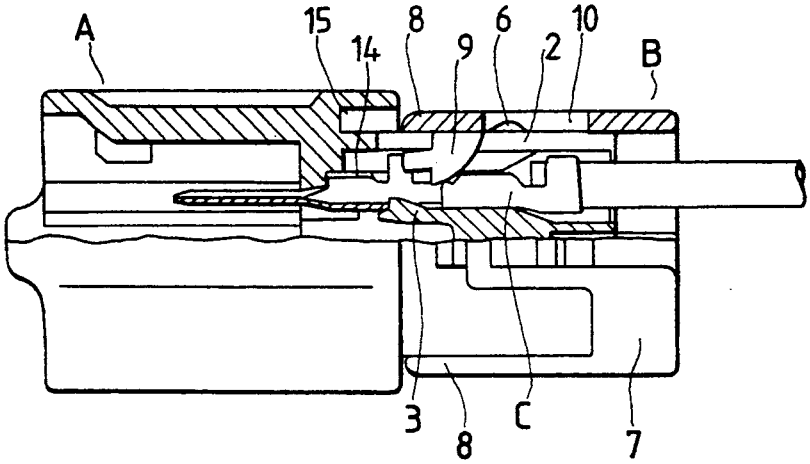
Figure 6C:
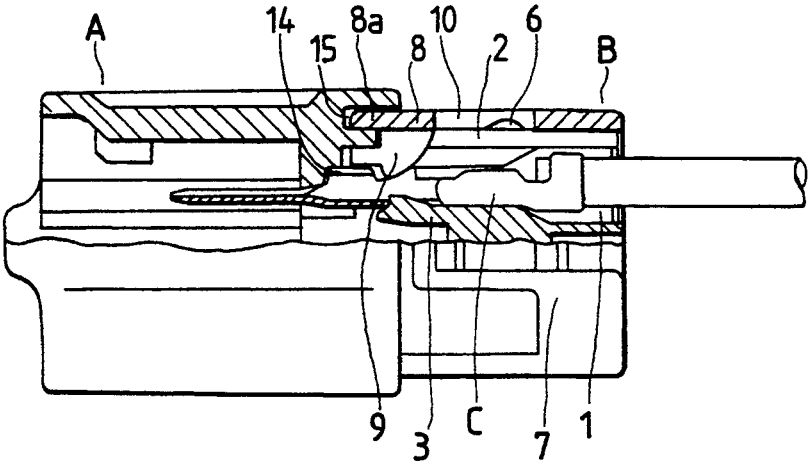
Figure 7:
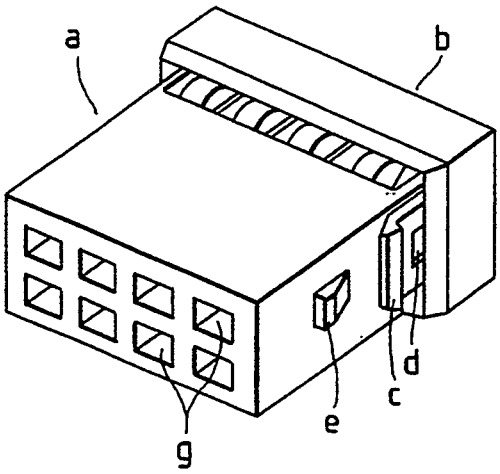
FIG. 7 PRIOR ART
FIG. 7 is a perspective view of a conventional connector housing with a terminal retainer.
Figure 8:
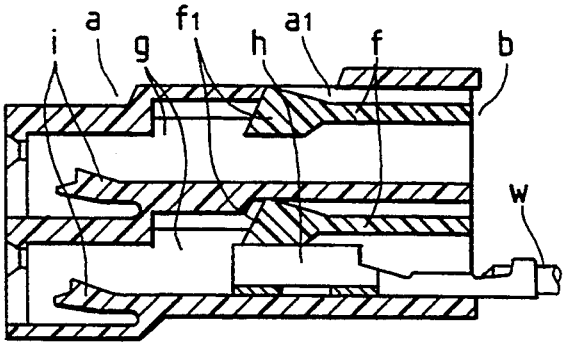
FIG. 8 PRIOR ART
FIG. 8 is cross-sectional view of a provisionally connected condition of the conventional connector.
Figure 9:
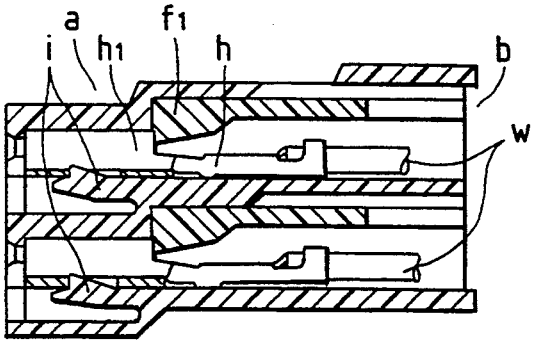
FIG. 9 PRIOR ART
FIG. 9 is a cross-sectional view of a completely connected condition of the convectional connector.
Figure 10:
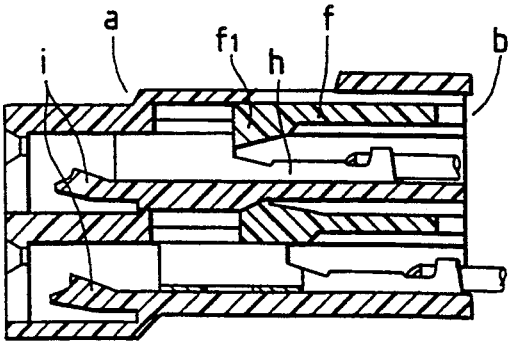
FIG. 10 PRIOR ART
FIG. 10 is a cross-sectional view of a metal terminal moving toward the completely connected condition.

In this condition, when the terminal retainer B is slightly advanced, the push-up projections 6 are received in the respective relief notches 10, so that the flexible displaceable plates 8 are restored, and the terminal retaining projections 9 lie deep in the respective terminal receiving chambers 1 (FIG. 6(B)). Then, when the terminal retainer B is further advanced, the housing retaining arms 11 are engaged respectively with the completely-retaining projections 13 to achieve a completely-connected condition, in which case the terminal retaining projection 9 is disposed adjacent to the rear end of an intermediate portion 14 of the metal terminal C, thereby achieving a double lock of the metal terminal C (FIG. 6(C)). In the completely-connected condition, an end portion 8*a* of the flexible displaceable plate 8 is engaged in a recess 15 in the connector housing A, thereby preventing the flexible displaceable plate 8 from accidentally moving.

In the above the first embodiment of the present invention, when the terminal retainer is in the provisionally-connected condition for a long period of time, the flexibility of the flexible displaceable plate placed on the push-up projection is lowered, and this results in a possibility that when the terminal retainer is advanced to achieve the completely-connected condition, the terminal retaining projection may not be engaged with the metal terminal because of an inadequate restoring force of the flexible displaceable plate, thus failing to achieve the double retaining effect.

Moreover, if the terminal which is in the incorrect insertion exists, it is impossible to detect the incorrect insertion of the terminal during the shifting from the provisionally-connected condition.

The following embodiments of the present of the present invention, as described hereinbelow provides certain advantages over the first embodiment, giving attention to the following characteristics of the first embodiment.

Figure 1:
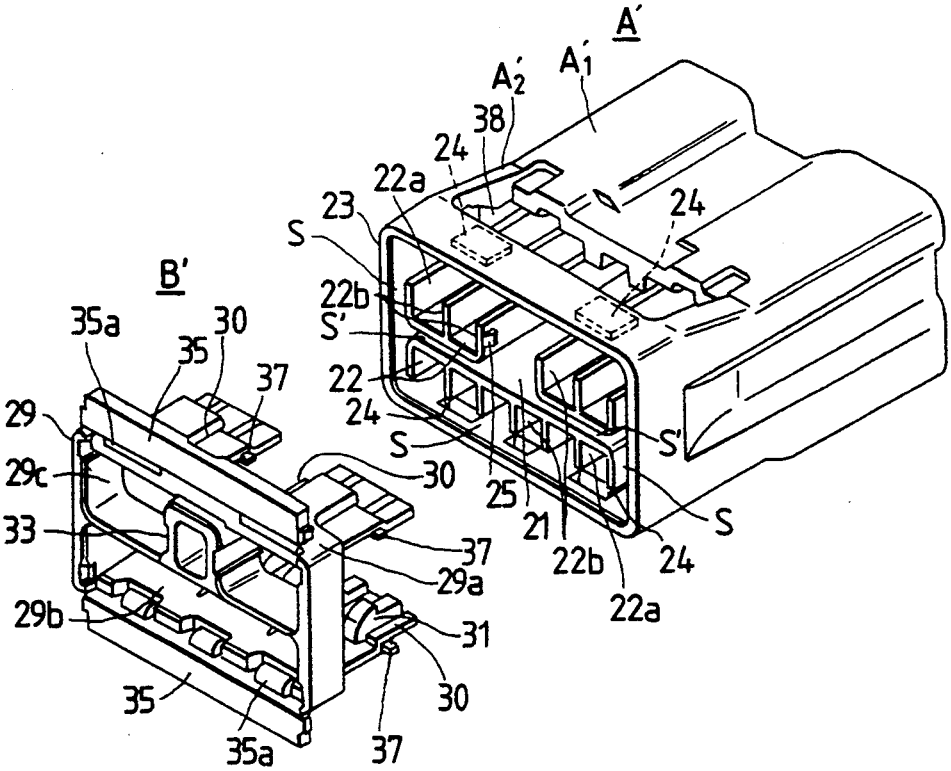
FIG. 1 is a perspective view of a second embodiment of the present invention.
Figure 2:
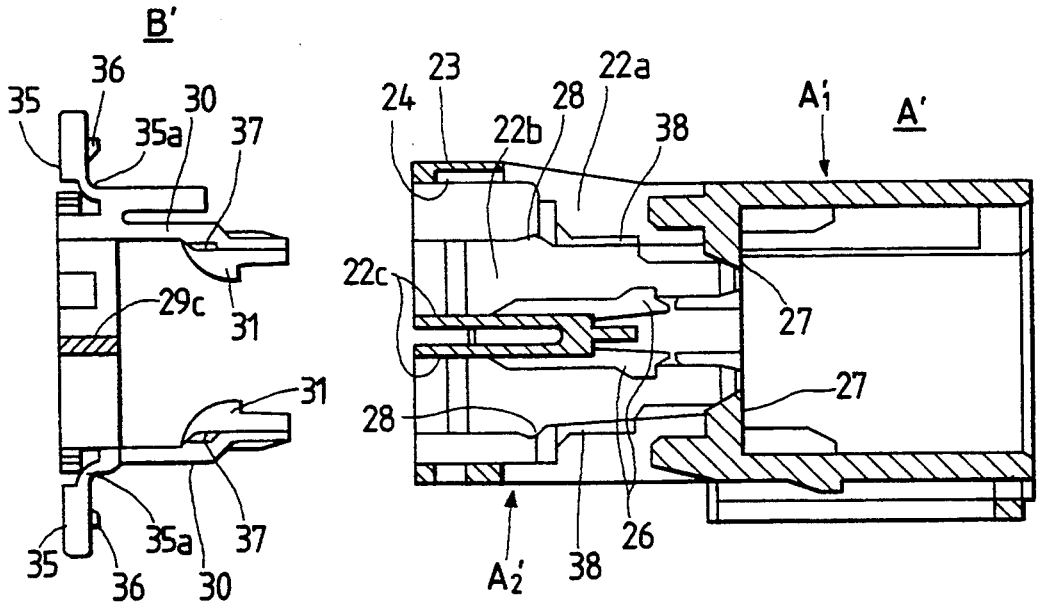
FIG. 2 is a cross-sectional view of the second embodiment of the present invention.
Figure 3A:
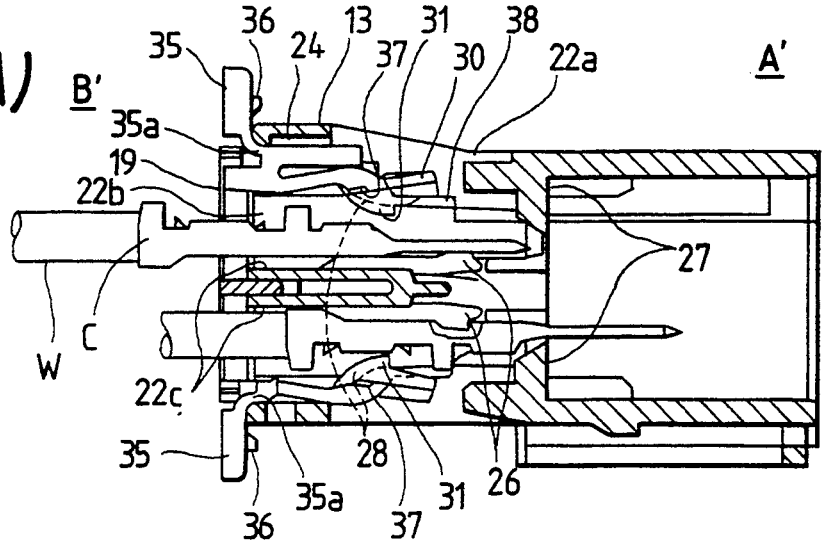
FIGS. 3 (A), (B) and (C) are cross-sectional views of the second embodiment, showing a provisionally-connected condition, a completely-connected condition, and a terminal-disengaging condition, respectively.
Figure 3B:
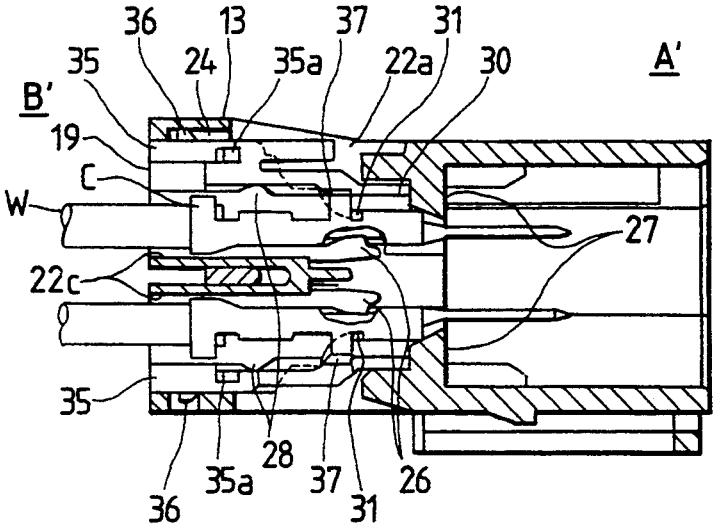

In a second embodiment of the present invention shown in FIGS. 1 to 3, each of a female-type connector housing A and a terminal retainer B is integrally molded of a synthetic resin.

The connector housing A' of the female type has a hood portion $A_1'$ at its front half portion, and a group $A_2'$ of terminal receiving chambers at its rear half portion. With respect to the terminal receiving chamber group $A_2'$, four terminal receiving chambers 22 are juxtaposed at the upper stage, with a receiving space 21 provided at the central portion thereof. Six terminal receiving chambers 22 are juxtaposed at the lower stage. The terminal receiving chambers 22 at the upper stage have upwardly-directed open portions 22*a*, respectively, and the terminal receiving chambers 22 at the lower stage have downwardly-directed open portions 22*a*, respectively.

A hood 23 is provided around the periphery of the rear portion of the terminal receiving chamber group $A_2'$, with an annular space S provided therebetween. Completely-retaining engagement portions 24 for the terminal retainer B are formed on the upper and lower portions of the hood 23 (see FIG. 3). On the other hand, projections 25 for preventing the withdrawal of the terminal retainer B are formed respectively on partition walls 22*b* of the terminal receiving chambers 22 facing the receiving space 21. A gap S' is formed between the terminal receiving chambers 22 of the upper stage and the terminal receiving chamber 22 of the lower stage. Drive grooves 38 are formed in inner surfaces of side walls connecting the hood 23 to the hood portion $A_1'$.

As shown in FIG. 2, a flexible retaining piece 26 which extends forwardly is formed on a bottom wall 22*c* of the terminal receiving chamber 22. The flexible retaining piece 26 serves as a primary retaining member for preventing the rearward withdrawal of a metal terminal C. A stopper wall 27 for the metal terminal C is formed at the front portion of the terminal receiving chamber 22. A triangle-shaped push-up projection 28 having a tapered surface extending in the front-to-rear direction is formed on that edge of the partition wall 22*b* of the terminal receiving chamber 22 disposed close to the open portion 22*a*.

The terminal retainer B includes a main frame 29 having upper and lower plate portions 29*a* and 29*b* from which plate-like flexible support pieces 30 extend forwardly. One flexible support piece 30 is provided for two or three terminal receiving chambers 22.

A plurality of terminal retaining projections 31 corresponding in arrangement to the terminal receiving chambers 22 are formed on the inner surfaces of the flexible support pieces 30, respectively. Driven projections 37 are formed on the outside portions of the flexible support pieces 30.

An intermediate plate portion 29*c* is formed in the main frame 29 of the terminal retainer B, and a fitting portion 33 for the receiving space 21 is formed between the upper plate portion 29*a* and the intermediate plate portion 29*c*. Retaining pieces (not shown) for the withdrawal prevention projections 25 are formed on the opposite sides of the fitting portion 23, respectively.

An engagement plate 35 is connected by a hinge portion 35*a* to the rear portion of each of the upper and lower plate portions 29*a* and 29*b* of the main frame 29, the engagement plate 35 being normally urged in an upstanding direction by the hinge portion 35*a*. Completely-retaining projections 36 for the completely-retaining engagement portions 24 are formed on the outer surface of the engagement plate 35.

In the above construction, the terminal retainer B is beforehand connected to the connector housing A' in a provisionally-connected condition. In the provisionally-connected condition, the upper and lower flexible support pieces 30 of the terminal retainer B, as well as the upper and lower plate portions 29*a* and 29*b*, are inserted in the upper and lower portions of the annular space S, and also the intermediate plate portion 29*c* is inserted in the gap S', and the flexible support pieces 30 is placed on the push-up projection 28 of the partition walls 22*b*, so that the terminal retaining projection 31 is disposed out of the path of insertion of the metal terminal C (FIG. 3(A)).

In the provisionally-connected condition, the engagement plates 35 in the upstanding condition are abutted against the rear end of the hood 23 to prevent the terminal retainer B from accidentally moving into the interior.

In the provisionally-connected condition, the metal terminals C are inserted into the terminal receiving chambers 22, respectively. At this time, since the terminal retaining projection 31 is disposed out of the path of movement, the metal terminal can be smoothly inserted, and the metal terminal impinges on the stopper wall 27, so that the metal terminal is primarily retained by the flexible retaining piece 26 against rearward withdrawal (FIG. 3(A)).

Then, the upstanding engagement plates 35 are laid flat, and the terminal retainer B is pushed into the connector housing A', and the completely-retaining projections 36 of the engagement plates 35 are engaged with the completely-retaining engagement portions 24 of the hood 23, respectively, to thereby achieve a completely-connected condition. At this time, the driven projections 37 formed at the outside portions of the flexible support pieces 30 are engaged respectively in the drive grooves 38 formed in the inner surfaces of the side wall portions of the connector housing, and are guided by these drive grooves, so that the flexible support pieces 30 are forcibly driven in their restoring direction, and the terminal retaining projection 31 of the flexible support piece 30 is disposed close to the intermediate retaining portion $C_1$ to thereby prevent the rearward withdrawal of the metal terminal C in a secondary manner (FIG. 3(B)).

Figure 3C:
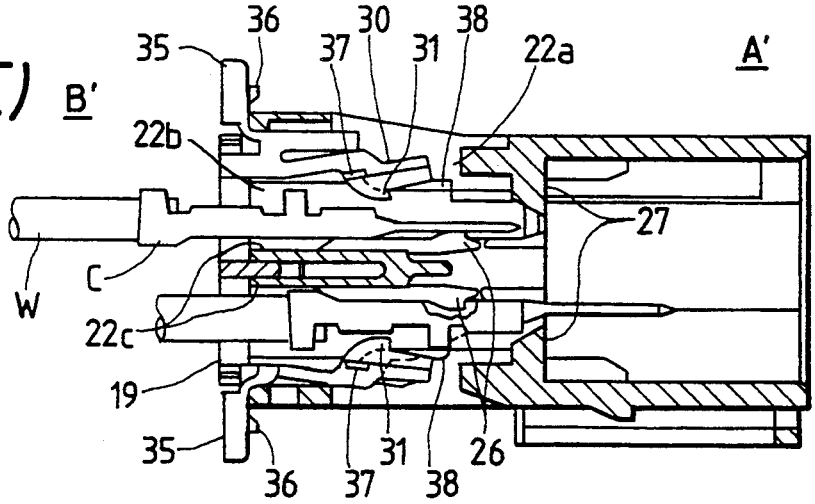

When it becomes necessary to exchange the metal terminal C because of its breakage or the like, the completely-retaining projections 36 are disengaged from the completely-retaining engagement portions 24, respectively, and the terminal retainer B is returned to the provisionally-retained position, and the engagement of the flexible retaining piece 26 is released by a jig, and the metal terminal C is withdrawn through a wire W (FIG. 3(C)).

Figure 4A:
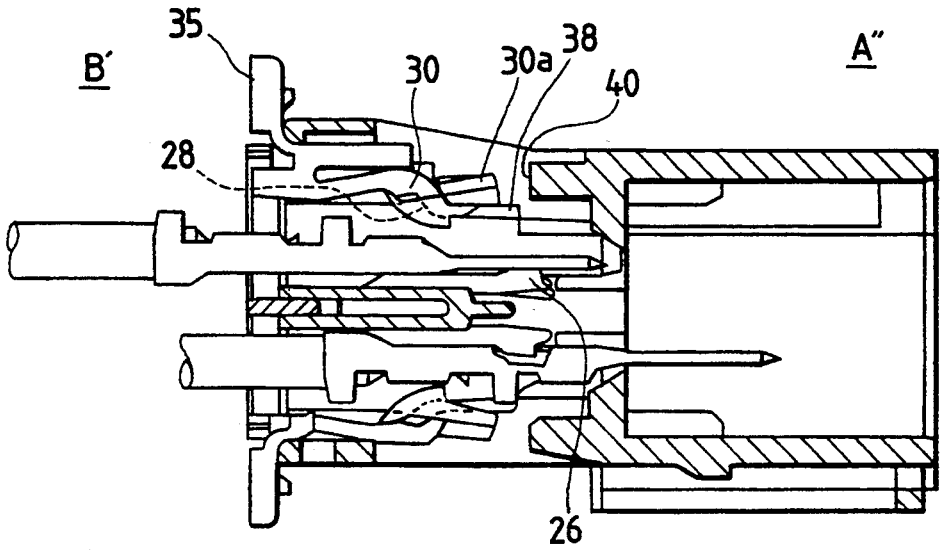
FIGS. 4 (A) and (B) are perspective views of a third embodiment of the present invention showing a provisionally-connected condition and a incorrect insertion of a terminal retainer which is detected.

According to third embodiment of the present invention shown in FIG. 4, distal ends 30*a* of flexible support pieces 30 on a terminal retainer B' held in the provisionally connected condition relative to a connector housing A'' (see FIG. 4(A)) face to the rear end surface of a hood portion $A_1'$, and a shock absorbing taper surface 40 slantwise extending in the forward direction is formed on the rear end surface of the hood portion $A_1'$.

Figure 4B:
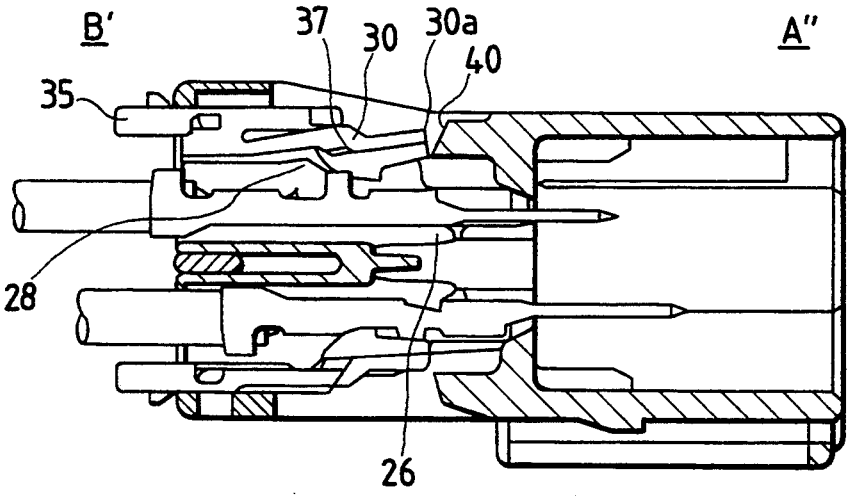

In the shown case, if some terminal C are incorrectly inserted into the connector housing A'' as shown in FIG. 4(B) when the terminal engagement section B' is shifted from the provisionally connected condition to the real connected condition, the distal ends 30*a* of the flexible support pieces 30 come in contact with the taper surface 40 at the rear end of the hood portion $A_1'$, causing the flexible support pieces 30 to be conducted to the outside. Thus, the displacement of the terminal retainer B' from the provisionally connected condition to the real connected condition is completely inhibited. In case that the shock absorbing taper surface 40 is not formed at the rear end of the sheath section $A_1'$, there arises a malfunction that the distal ends 30*a* of the flexible support pieces 30 collide against the rear end surface of the hood portion $A_1'$, resulting in the rear end surface of the same being damaged or injured. In this embodiment, however, there does not arise the foregoing malfunction without any possibility that the terminal retainer B' is erroneously displaced to the real connected condition from the provisionally connected condition.

As described above, in the present invention, the connector comprises the connector housing having a plurality of terminal receiving chambers, and the terminal retainer mounted on the rear portion of the connector housing so as to move in a two-stage manner, that is, between the provisionally-connected condition and the completely-connected condition, wherein the flexible support pieces for the metal terminals are provided on the terminal retainer; the flexible retaining piece for the metal terminal is provided at each of the terminal receiving chambers; in the provisionally-connected condition of the terminal retainer, the flexible support piece is placed on the push-up projection of the connector housing to be held out of a path of movement of the metal terminal within the terminal receiving chamber; and when the terminal retainer shifts to the completely-connected condition, the driven projection on the flexible support piece is engaged in the drive groove in the connector housing to forcibly drive the flexible support piece into engagement with the metal terminal. Therefore, the flexible support piece, which is held out of the path of movement of the metal terminal in the provisionally-connected condition of the terminal retainer, can be positively engaged with the metal terminal in the completely-connected condition.

According to the present invention, there is provided a connector of the foregoing type that, in the provisionally-connected of said terminal retainer, a distal end of the flexible support piece faces to a shock absorbing tapered surface forward slantwise extending at a rear end of the connector housing in the provisionally-connected of said terminal retainer, and that if the terminal which is in the incorrect insertion exists, the distal end of the flexible support piece is brought into contact with the shock absorbing tapered surface during the shifting from the provisionally-connected to the completely-connected condition to detect the terminal which is in the incorrect insertion.

What is claimed is:

1. A connector comprising:

a connector housing having a plurality of terminal receiving chambers; and a terminal retainer mounted on a rear portion of said connector housing so as to be movable between a provisionally connected condition and a completely connected condition, wherein said terminal retainer includes flexible support pieces for retaining metal terminals in said completely connected condition, and a flexible retaining piece for retaining said metal terminal is provided at each of said terminal receiving chambers, and wherein said connector housing has a shock absorbing taper surface extending slantwise in a front to rear direction at a rear end portion thereof.

2. A connector as claimed in claim 1, wherein a distal end of the flexible support piece faces said shock absorbing taper surface in said provisionally connected condition, and a distal end of the flexible support piece is brought into contact with said shock absorbing taper surface when said terminal retainer is moved toward the completely-connected condition and when a terminal is incompletely inserted.

3. A connector as claimed in claim 1, wherein said flexible support piece includes a driven projection and said connector housing has a drive groove provided in a side wall thereof, said projection being guided by said groove.

4. A connector as claimed in claim 3, wherein said flexible support piece is disposed on a push-up projection of said connector housing to be held out of a path of movement of said metal terminal within said terminal receiving chamber in said provisionally connected condition, and wherein when said terminal retainer shifts to said completely-connected condition, said flexible support piece is forced into engagement with said metal terminal due to the engagement of said driven projection in said drive groove.

5. A connector, comprising:

a connector housing having a plurality of terminal receiving chambers and a retaining piece extending into each of said receiving chambers; and a terminal retainer attachable to a rear portion of said connector housing and being movable from a provisionally connected condition to a completely connected condition, said terminal retainer including a flexible support piece associated with each of said terminal receiving chambers for retaining metal terminals when said terminal retainer is in said completely connected condition, wherein said connector housing includes deflecting means for deflecting said flexible support pieces outwardly so as to be disposed out of an insertion path of the metal terminals in said receiving chambers when said terminal retainer is in said provisionally connected condition.

6. The connector of claim 5, wherein said housing includes side walls which respectively partially define said receiving chamber.

7. The connector of claim 6, wherein said deflecting means includes cam projections respectively provided on said side walls.

8. The connector of claim 5, further comprising means for forcing said flexible support pieces into said insertion path when said terminal retainer is moved from said provisionally connected condition to said completely connected condition.

* * * * *